US005249723A

United States Patent [19]

Lamadelein

[11] Patent Number: 5,249,723

[45] Date of Patent: Oct. 5, 1993

[54] CARRIER FOR SHAFTED EQUIPMENT

[76] Inventor: Joseph F. M. Lamadelein, 2379 Blackstone Cr., Ottawa, Ontario, Canada, K1B 4H3

[21] Appl. No.: 779,275

[22] Filed: Oct. 18, 1991

[51] Int. Cl.[5] ..... A45F 3/14

[52] U.S. Cl. ..... 224/257; 211/60.1; 294/159; 206/315.2; 24/531

[58] Field of Search ..... 224/202, 247, 257, 249, 224/917, 269; 294/143, 144, 146, 147, 159, 160; 211/60.1, 70.2, 70.5, 70.8; 206/315.2, 315.1; 273/32 E; 24/336, 545, 531, 555; 280/814; 248/110

[56] References Cited

U.S. PATENT DOCUMENTS

| | | | |
|---|---|---|---|
| 3,231,076 | 1/1966 | Freiman | 24/336 X |
| 3,259,284 | 7/1966 | Olson | 294/142 |
| 3,626,553 | 8/1970 | Darney | 280/814 |
| 3,880,336 | 4/1975 | Demasson | 294/169 X |
| 3,893,606 | 7/1975 | Hofmann | 280/814 X |
| 4,190,182 | 2/1980 | Hickey | 294/147 |
| 4,221,314 | 9/1980 | Baker | 280/814 X |
| 4,699,415 | 10/1987 | Skovajsa | 224/257 X |
| 4,784,305 | 11/1988 | Schoenberg | 206/315.1 X |
| 4,871,102 | 10/1989 | Wickersham | 294/147 X |
| 4,988,007 | 1/1991 | Chiarot | 211/70.5 |

FOREIGN PATENT DOCUMENTS

| | | | |
|---|---|---|---|
| 3616718 | 11/1987 | Fed. Rep. of Germany | 280/814 |
| 165106 | 1/1934 | Switzerland | 24/336 |
| 1455364 | 11/1976 | United Kingdom | 24/336 |

*Primary Examiner*—Henry J. Recla
*Assistant Examiner*—Glen T. Barrett
*Attorney, Agent, or Firm*—Larson and Taylor

[57] ABSTRACT

A carrier for elongate equipment for sports, such as hockey, curling, ringette or the like arranged to hold two pieces of equipment each of which includes an elongate shaft. The carrier includes two elongate essentially U-shaped channels formed of resilient plastic material. The channels are so dimensioned that at least one wall thereof is biased against the shaft, and thus retaining it, when the shaft is inserted therein. Provision is made for attaching a suitable carrying strap to the carrier or to facilitate attachment of the carrier to an equipment bag or the like.

14 Claims, 2 Drawing Sheets

CARRIER FOR SHAFTED EQUIPMENT

This invention relates to hand carriers for elongate equipment for sports or the like, and is particularly suitable for various forms of sports equipment which includes an elongate shaft. Many sports utilise such equipment, such as ice hockey, field hockey, ringette, lacrosse, curling, badminton, tennis, golf and skiing, to mention a few. For example, hockey players generally carry at least two hockey sticks, as well as ice equipment bag. In the absence of a suitable carrier for the sticks, this is a cumbersome and awkward burden to manage, particularly through doorways, and in using buses, trains, and the like.

This invention seeks to provide a suitable carrier for such elongate sports equipment which can be carried by means of a strap or alternatively attached to the outside of an equipment bag.

Various devices for carrying such equipment have been proposed, such as ski carriers constructed and adapted to be used on the roof of a car. Some ski carriers, such as in Olson, U.S. Pat. No. 3,259,284, include a means to attach ski boots. This type of carrier is relatively costly to manufacture and apparently incapable of adaptation as a hockey stick carrier. Hickey, U.S. Pat. No. 4,190,182, describes a carrier for both skis and ski poles adapted to be attached to a car roof rack.

A hockey stick carrier is described by Demasson, U.S. Pat. No. 3,880,336, which comprises a metal framework with cross pieces which retain, but do not grip, the sticks. Similarly Cadre, Canada 1,269,962, describes a strap-like arrangement for binding a plurality of hockey sticks together which includes a handle to facilitate carrying them.

This invention seeks to provide a carrier for elongate objects such as hockey sticks that can be conveniently carried, and which reliably and conveniently secures such elongate objects of different cross-sectional dimensions without adjustment. Further, both placement in and removal from the carrier is simple and straight forward.

Further this invention seeks to provide a carrier that is durable and light weight.

Furthermore, this invention seeks to provide a carrier with these features which can be fabricated by high speed injection molding techniques, thereby reducing the cost of manufacture.

Thus in a first broad embodiment this invention provides a carrier adapted to retain a plurality of elongate shaft members, comprising a plurality of connected substantially U-shaped channels of resilient material, each channel having a substantially flat bottom, a first elongate sidewall and a second elongate sidewall, and having attachment means for a strap means, wherein:

(i) the first elongate sidewall is angled inwardly toward the second elongate sidewall so that the included angle between the first elongate sidewall and the bottom is less than 90°;

(ii) the first elongate sidewall includes a plurality of discontinuous relatively narrow lip sections facing inwardly into the channel at its top edge;

(iii) the second elongate sidewall is substantially perpendicular to the bottom; and (iv) the second elongate sidewall includes a plurality of relatively short discontinuous relatively narrow lip sections facing inwardly into the channel at its top edge.

Preferably the second elongate sidewall includes at least one ridge on the face of the sidewall between at least one lip section and the bottom of the channel.

Most preferably, the sidewall ridges are thinner than the adjacent lip.

Preferably the narrow lip on the first elongate sidewall extends in either continuous or interrupted form for the major portion of the length of the channel and most preferably extends for substantially the length of the first sidewall.

Conveniently the carrier includes two channels, sharing a common sidewall therebetween.

The invention in one embodiment will now be described by way of reference to the attached drawings, in which.

Figure 1:
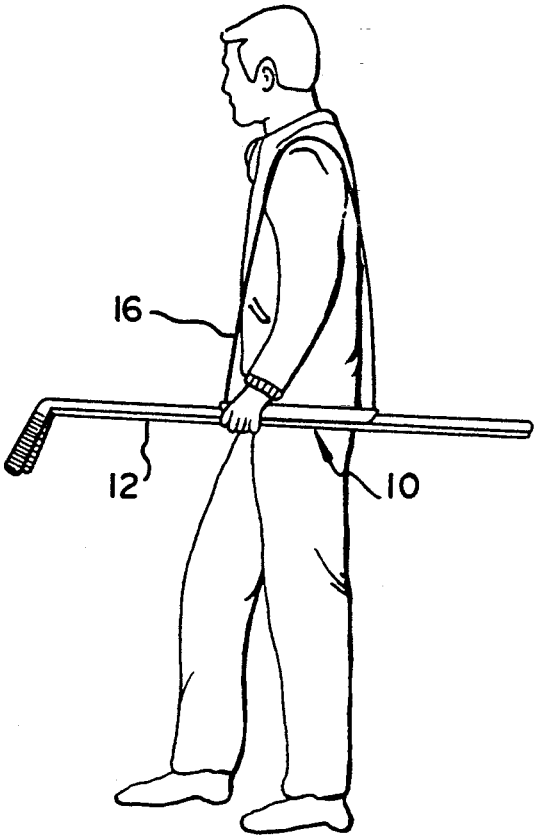
FIG. 1 is a perspective view showing the carrier in use.

Referring now in detail to the drawings, the carrier is shown generally at 10 in each Figure. In FIG. 1 it is shown supported by a carrying strap 16, and holding a pair of hockey sticks, 12. The construction of the carrier is shown in more detail in FIGS. 2 and 3, from which the strap 16 is omitted for clarity. As shown, the carrier includes two channel members 14 and 18. These two share a common second elongate sidewall 20, and have separate first elongate sidewalls 22, 24. Each first sidewall 22, 24 has a narrow inwardly facing lip 26, 28.

For the channel 14 the lip 26 runs for substantially the entire length. It is not necessary that the lip is the length of the sidewall, and gaps can be left in it, as is shown for the channel 18 at the center thereof. Desirably, the lip extends for the major proportion of the length of the sidewall in continuous or interrupted form, and preferably is the length of the sidewall, as at 26.

Figure 3:
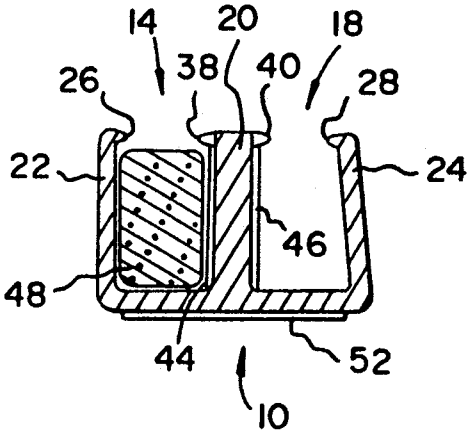
FIG. 3 is a cross-sectional view of the carrier showing one side in use.

As can be seen more clearly in FIG. 3, when the channel is empty, the first sidewall is angled inwardly so that the included angle at the bottom is less than 90°. Depending on the material used for the carrier, which conveniently is an injection molded plastic fabrication, an included angle of from 80° to less than 90° seems suitable. A preferred angle is about 86°, that is, the sidewall is angled inwardly by about 4°. The second sidewall 20 is shared between the two channels 14, 18. The sides facing into each channel are substantially the same. The top edge of the sidewall 20 includes a plurality of short discontinuous relatively narrow lip sections, as at 30, 34 and 38 in the channel 14 and 32, 36 and 40 in the channel 18. As shown, three sections are used, with those in each channel offset from each other. At least two such lip sections are desirable, with three being preferred, although more than three can be used. Similarly, it is not necessary that they be off set from each other.

Figure 2:
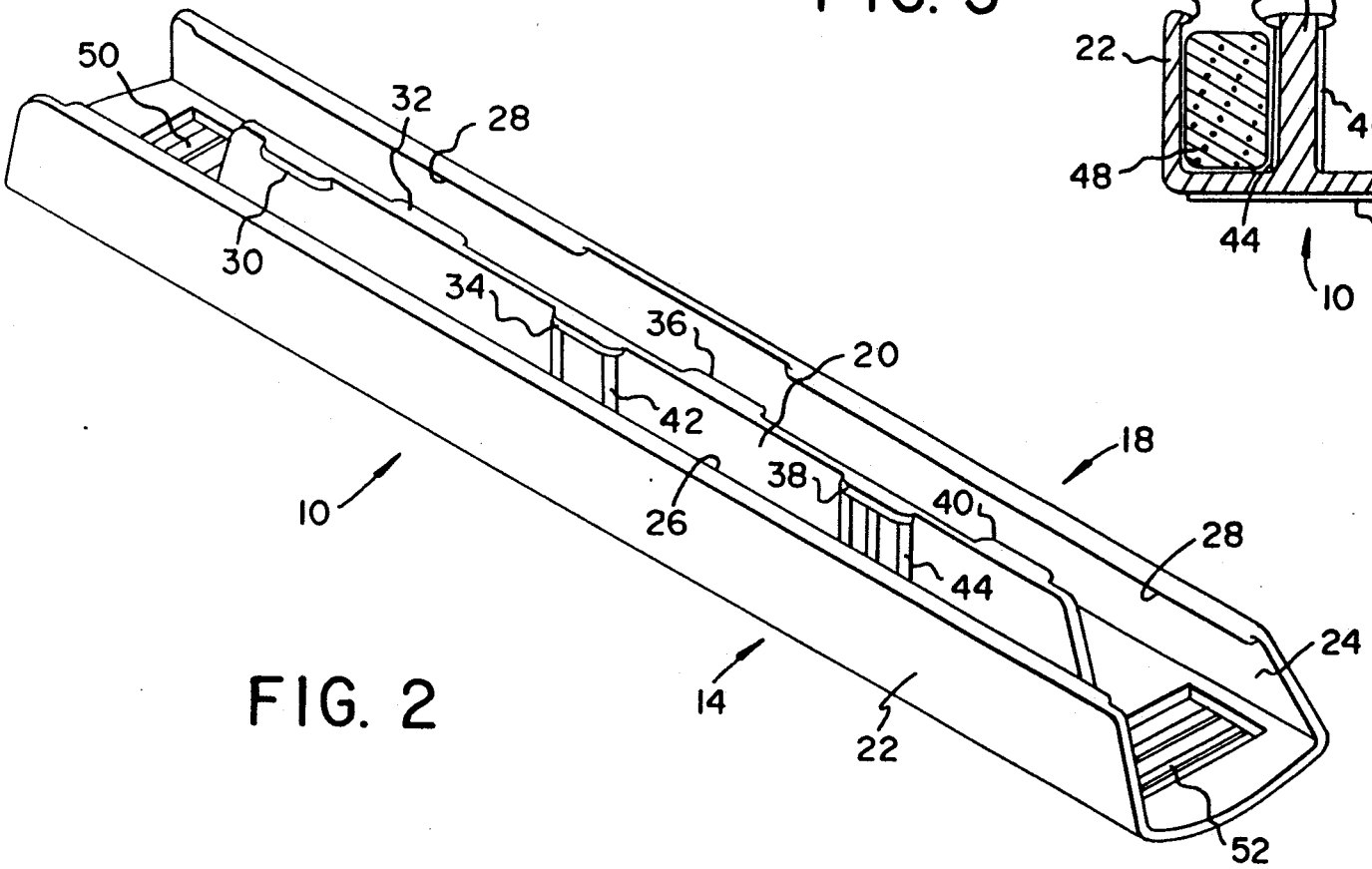
FIG. 2 is a perspective view of the carrier.

As shown in FIG. 2, the sidewall face between the lip section and the bottom of the channel as at 30 can be left plain. Alternatively, as at 34 and 38 one or more narrow ridges 42, 44 can be incorporated between the lip section and the bottom of the channel, as can be seen at 44, 46 in FIG. 3. These ridges, as can be seen in FIG. 3, are preferably somewhat thinner than the lip section adjacent to them. They aid in the insertion and removal of the shaft.

As shown for the channel 14 in FIG. 3, a shaft for a hockey stick, for example, as at 48 first into the channel. In order to insert it or remove it the lips on the inner top faces of each of the sidewalls are separated, and the shaft pushed in between. This step also requires biasing the first sidewall outwardly. When the shaft is inserted, the first sidewall is released and becomes self biassing against the shaft, due to the first sidewall being angled inwardly initially.

As shown in FIG. 2, a strap 16 (as in FIG. 1) is conveniently attached by threading one end through a set of slots at each end of the carrier 10, as at 50, 52. Other attachment means may be used.

In FIG. 3 a single shaft 48, fills the channel 14. Generally, the carrier will be sized to do this, but it is within this invention to size each channel to accept a plurality of shafts. Further, as shown in FIGS. 2 and 3, two channels are used, and again this will usually be the most convenient. However, it is contemplated to include more than two: for example, a unit of four channels in which the second sidewalls and bottoms are common walls is contemplated. Different strap attachment means would then be required.

It is also to be noted that this carrier is not limited to a shaft of relatively constant dimensions. Due to the inward angling of the first wall a tapering shaft can easily be accomodated.

The embodiments of the invention in which an exclusive property or privilege is claimed are defined as follows:

1. A carrier adapted to retain a plurality of elongate shaft members, comprising a plurality of connected adjacent substantially U-shaped elongated channels of resilient material, said elongated channels being adapted to extend along and receive the elongated shaft members, each channel having a substantially flat bottom, a first elongate sidewall and a second elongate sidewall, said first and second sidewalls being connected to said bottom wherein:

(i) the first elongate sidewall is angled inwardly toward the second elongate sidewall so that an included angle between the first elongate sidewall and the bottom is less than 90°;

(ii) the first elongate sidewall includes a top edge having at least one narrow lip section facing inwardly into the channel toward said second side wall;

(iii) the second elongate sidewall is substantially perpendicular to the bottom; and (iv) the second elongate sidewall includes a top edge having a plurality of relatively short discontinuous relatively narrow lip section extending inwardly into the channel toward said first sidewall; and (v) attachment means at each end of said flat bottom for receiving a carrier strap.

2. A carrier according to claim 1 wherein the included angle is greater than 80°.

3. A carrier according to claim 2 wherein the include angle is about 86°.

4. A carrier according to claim 1 wherein the narrow lip sections extend for a major portion of the first sidewall.

5. A carrier according to claim 1 wherein the second elongate sidewall includes an inner face having at least one inwardly projecting ridge extending between at least one lip section and the bottom of the channel.

6. A carrier according to claim 3 wherein each ridge is thinner than its adjacent lip section.

7. A carrier according to claim 5 including one ridge adjacent at least one lip section.

8. A carrier according to claim 5 including two ridges adjacent at least one lip section.

9. A carrier according to claim 5 including three ridges adjacent at least one lip section.

10. A carrier according to claim 5 including at least one ridge adjacent each lip section.

11. A carrier according to claim 5 including at least two ridges adjacent each lip section.

12. A carrier according to claim 5 including at least three ridges adjacent each lip section.

13. A carrier according to claim 1 including two channel members having a common second elongate sidewall.

14. A carrier according to claim 1 in which the attachment means comprises at least one slot adjacent each end of the bottom.

* * * * *